US007841096B1

(12) United States Patent
Jenkins

(10) Patent No.: US 7,841,096 B1
(45) Date of Patent: Nov. 30, 2010

(54) GOLF TEE MARKING DEVICE

(76) Inventor: Bryant Moses Jenkins, 6900 Lake Woodlands Dr., Apt. 231, The Woodlands, TX (US) 77382

( * ) Notice: Subject to any disclaimer, the term of this patent is extended or adjusted under 35 U.S.C. 154(b) by 0 days.

(21) Appl. No.: 12/623,443

(22) Filed: Dec. 24, 2009

(51) Int. Cl.
*A63B 57/00* (2006.01)

(52) U.S. Cl. ..... 33/485; 473/386

(58) Field of Classification Search ..... 33/483, 33/485, 832, 833, 666; 473/386–403
See application file for complete search history.

(56) References Cited

U.S. PATENT DOCUMENTS 2,950,110 A * 8/1960 Slotta et al. ..... 473/386
3,658,331 A * 4/1972 Driscoll ..... 473/386
4,063,731 A * 12/1977 Kitay ..... 473/286
4,896,883 A * 1/1990 Wagenknecht ..... 473/386
4,982,510 A * 1/1991 Musillo ..... 33/833
D314,922 S * 2/1991 Musillo ..... D10/64
5,735,758 A * 4/1998 Miketinac ..... 473/386
5,913,737 A * 6/1999 Park ..... 473/386
7,044,866 B1 * 5/2006 Blauvelt ..... 473/386
7,223,184 B2 * 5/2007 Suwito ..... 473/386
2007/0266584 A1 * 11/2007 Munson ..... 33/666

* cited by examiner

*Primary Examiner*—Yaritza Guadalupe-McCall

(57) ABSTRACT

The present invention relates to a depth or height-marking device for golf tees, which will allow golfers to mark golf tees at a desired location on the golf tee, relative to the height at which the golfer wants the ball to sit on the golf tee above the ground. The device is comprised of a device body and measurement scale. The unique design of the device body allows for the marking of golf tees of various lengths without having to change the size of the device body.

1 Claim, 1 Drawing Sheet

FIG. 1
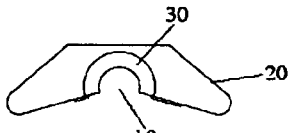
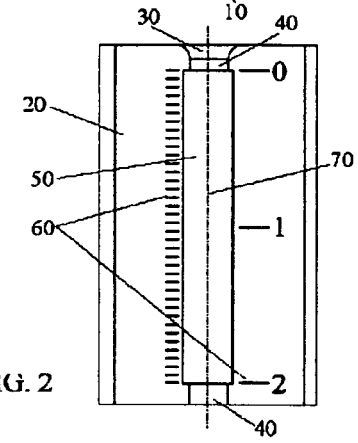
FIG. 2
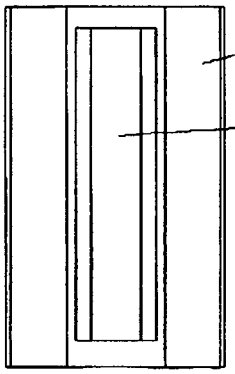
FIG. 3
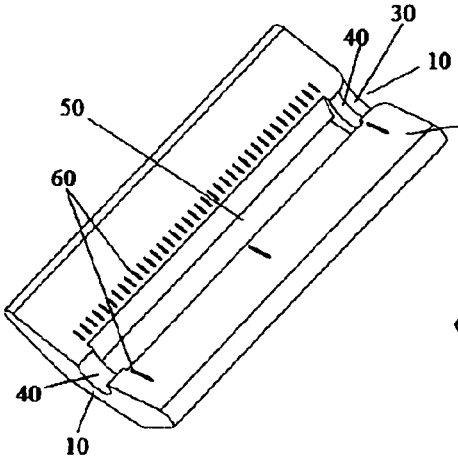
FIG. 4
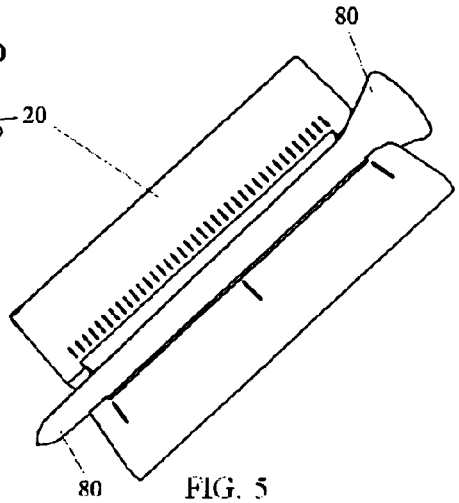
FIG. 5
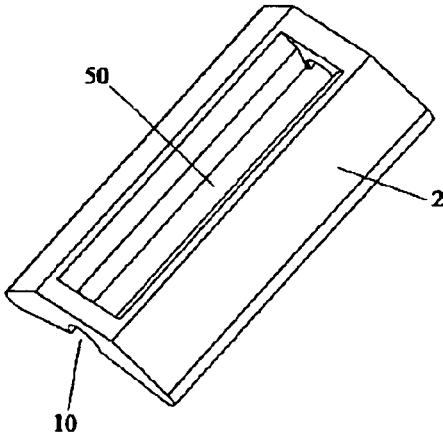
FIG. 6
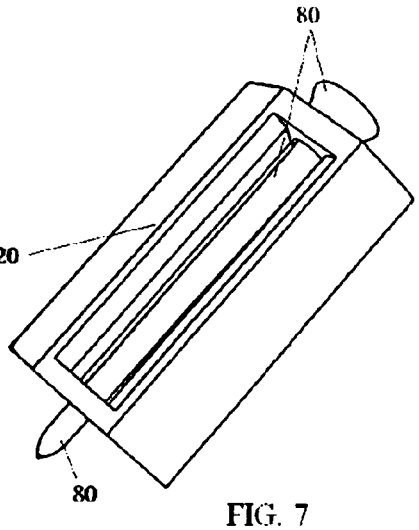
FIG. 7

GOLF TEE MARKING DEVICE

FIELD OF INVENTION

The present invention relates generally to the game of golf, and more specifically to a golf tee-marking device, which will allow a golfer to precisely mark the golf tee at a desired location relative to the height at which the golfer would like the golf ball to sit on the golf tee above the ground.

BACKGROUND OF THE INVENTION

To play golf well, a golfer must be accurate and consistent when striking the golf ball. Since the first strike from the tee box sets the tone for the subsequent strikes for a given golf hole, this accuracy and consistency is of the utmost importance. To be effective from the beginning of each golf hole, a golfer must have consistency and repeatability in the placement of the golf ball prior to striking the ball. Since most shots from the golf tee box are performed with the golf ball resting on a golf tee, it is critically important that a golfer be able to place the golf ball, on the golf tee, at the desired height above the ground consistently. The present invention of the golf tee-marking device will allow a golfer to precisely mark the golf tee, at a desired location, relative to the height at which the golfer would like the golf ball to sit on the golf tee above the ground. The golfer needs only to insert the golf tee in the ground up to and including the visible line that was marked around the golf tee to ensure consistent ball placement.

There have been many inventions developed to help keep the golf tee height consistent for golfers, some of which are also golf tee marking devices, like the invention by Edward J. Blauvelt U.S. Pat. No. 7,044,8666 B1. This invention, as described by the patent document, uses a receptacle with the general shape of a golf tee, in the form of a cutout or slot, which is fully enclosed by the common surface of the marking device body. The golf tee is placed in the receptacle that helps to align the golf tee to the measurement scale. This marking device concept works well if the golfer only has tees of one size, but if the golfer has tees of multiple sizes, the golfer will need to have multiple marking devices of this cutout or slot type. Carrying around multiple marking devices of varying size is not practical. Another drawback of this marking device invention is that the general size of the marking device body is dictated by the minimum size of the receptacle needed to receive the golf tee—so if you have a golf tee of 4 inches or more in length, the receptacle will also need to be 4 inches or more in length. Carrying multiple marking devices, or a marking device of greater than 4 inches or more in length, would prove to be less than desirable for golfers.

SUMMARY OF INVENTION

It is the primary object of the present invention, to provide golfers with a simple yet practical method for consistently marking a golf tee, at a desired location, relative to the height at which the golfer would like the golf ball to sit on the golf tee above the ground. The golf tee marking device works by either inserting or placing a golf tee in or on the device. Once the golf tee is in or on the device, a golfer will use the measurement scale listed on the device to determine where the golf tee should be marked. The golfer will then use a marking instrument to mark the golf tee at the desired location.

An additional object of the present invention is to allow a golfer to mark a golf tee that is longer than the golf tee marking device without having to use a larger or different golf tee marking device. The golfer can mark the golf tee more than once. The first mark would be used to indicate the current location of the portion of the golf tee that is within the measurement scale range. Each subsequent mark can be made on the desired portion of the golf tee that was out of the measurement scale range, once the desired portion moves into the measurement scale range. This is made possible by the open ends design of the golf tee marking device body. The golfer can slide the golf tee along the device body centerline, until the portion of the tee outside the measurement scale is within the measurement scale at a location desired to be marked by the golfer.

The golf tee marking device can be made of any rigid material with a sufficient material thickness to help prevent structural failure of the device. The primary features of the present invention are a rigid device body having supports and open ends down the device body centerline, and having a opening through the center of the device from front to back. The front of the device body has a measurement scale on both sides of the device body centerline. The device body has details that allow for the placement of a golf tee in or on the device and having adequate open areas to allow for a marking instrument to mark the golf tee in a desired location. The measurement scale is aligned with key open areas to allow for accurate marking.

To use the device, a golfer will place a golf tee in the device, and locate a desired scale indicator mark relative to the point at which the golfer wishes to mark the golf tee. The golfer will use a marking instrument to mark the golf tee in the location corresponding to the desired scale indicator mark. After the golf tee is marked, the golfer will remove the golf tee from the device, and insert the golf tee in the ground up to and including the visible mark made on the golf tee by the golfer with the marking instrument.

BRIEF DESCRIPTION OF DRAWINGS

FIG. 1 shows a top view of the golf tee marking device, with the open end design contoured to resemble the contoured portion of a golf tee.

FIG. 2 shows a front view of the golf tee marking device, with the measurement scale listed on both sides of the device centerline and the opening through the center of the device from front to back.

FIG. 3 shows a back view of the golf tee marking device and the opening through the center of the device from back to front.

FIG. 4 shows a front perspective view of the golf tee marking device, with the device not in-use with the golf tee removed, and with the device in-use with a golf tee present in the device.

FIG. 5 shows a front perspective view of the golf tee marking device, with the device in-use with a golf tee present in the device.

FIG. 6 shows a back perspective view of the golf tee marking device, with the device not in-use with the golf tee removed.

FIG. 7 shows a back perspective view of the golf tee marking device, with the device in-use with a golf tee present in the device and visible from the back.

DETAILED DESCRIPTION OF INVENTION

The illustrations for FIG. 1 through FIG. 7 are provided to demonstrate the design and use of the golf tee-marking device. Reference FIG. 1, the top end of the golf tee-marking device, consisting of the device body 20, an open end 10, and a contoured surface 30 for supporting the contoured portion of a golf tee. Reference FIG. 2, the front view of the golf tee-marking device, consisting of the body 20, the contoured surface 30 for supporting the contoured portion of a golf tee, the supporting surfaces 40 on which the tee will rest, the opening through the center of the device 50 from front to back, and the measurement scales 60 on both sides of the device centerline 70. Reference FIG. 3 shows the back view of the golf tee marking device body 20, and the opening through the center of the device 50 from back to front. Reference FIG. 4 shows a front perspective view of the golf tee marking device body 20 and details 10, 30, 40, 50, and 60, as described in FIG. 1, FIG. 2, and FIG. 3. Reference FIG. 5 shows second illustration for FIG. 4 with a golf tee 80 shown as it would be used in the golf tee marking device body 20. Reference FIG. 6 shows a back perspective view of the golf tee marking device body 20, and details 10 and 50, as describe in FIG. 1, FIG. 2, and FIG. 3. Reference FIG. 7 shows a second illustration of FIG. 6 with a golf tee 80 shown from the back of the golf tee marking device body 20 as it would be if in use—the golf tee is clearly visible from the back of the golf tee marking device, which allows for marking from the front or back of the golf tee marking device.

I claim:

1. A golf tee marking device consisting of:

a) an elongated body comprising two surfaces connected at an angle and defining top and bottom angled surfaces, a longitudinal slot extending through the top and bottom angled surfaces forming a channel with dimensions adequate for receiving a golf tee;

b) said top angled surface of said elongated body possessing a plurality of marking indicia perpendicular to said longitudinal slot; and c) wherein said body is composed of a stiff material.

* * * * *